United States Patent [19]

Wiklund

[11] Patent Number: 4,538,656

[45] Date of Patent: Sep. 3, 1985

[54] METHOD FOR SAWING A LOG OR A BLOCK INTO PIECES OF LUMBER

[75] Inventor: Per M. Wiklund, Täby, Sweden

[73] Assignee: Trateknik Centrum, Stockholm, Sweden

[21] Appl. No.: 558,515

[22] Filed: Dec. 6, 1983

[30] Foreign Application Priority Data

Dec. 27, 1982 [SE] Sweden ..... 8207411

[51] Int. Cl.[3] ..... B27B 1/00; B27C 9/04

[52] U.S. Cl. ..... 144/378; 144/39; 144/367

[58] Field of Search ..... 144/37, 39, 367, 369, 144/376, 378

[56] References Cited

U.S. PATENT DOCUMENTS 3,934,630 1/1976 Cockle ..... 144/39
4,219,056 8/1980 Lindstrom ..... 144/39
4,324,277 4/1982 Kreibaum ..... 144/378

FOREIGN PATENT DOCUMENTS 280252 1/1952 Switzerland .

OTHER PUBLICATIONS

"Torking Under Press—Reduksjon Av Kuving?", *Norsk Treteknisk Institutt,* No. 6, 1981.

*Primary Examiner*—W. D. Bray
*Attorney, Agent, or Firm*—Young & Thompson

[57] ABSTRACT

The present invention relates to a process for sawing a log or a block into pieces of lumber, such as blocks, planks, boards, etc. The method is characterized in that pieces of lumber are sawn out with longitudinal cut surfaces such that—when the log is viewed in cross section—the lateral surface of the piece of lumber facing the center of the log is substantially concave while its lateral surface facing away from the center of the log is substantially convex, the concavity and convexity being adapted to the local tangential and radial shrinkage properties of the wood so that the sawn pieces, after drying to the desired moisture ratio, will have substantially plane-parallel sides.

8 Claims, 4 Drawing Figures

METHOD FOR SAWING A LOG OR A BLOCK INTO PIECES OF LUMBER

The present invention relates to a method for sawing a log or a block into pieces of lumber, such as blocks, planks, boards, etc.

In conventional sawing of logs into pieces, for example blocks, planks, boards, etc., as a rule frame saws or circular saws are used: first the log is edged and then the block is square sawed into a number of parallel boards. When the moisture ratio of the sawn pieces drops during drying to below the fibre saturation point, the wood begins to shrink. Because of the wood structure, however, the piece does not shrink equally in all directions; rather it shrinks, as viewed in cross section, more tangentially, i.e. radially. For Swedish conifers for example, the tangential shrinkage is almost twice as great as the radial shrinkage. Shrinkage in the fiber direction, however, is almost always negligible. When the moisture ratio of the wood drops below the fiber saturation point, the pieces of lumber are therefore subjected to a non-uniform shrinkage so that they become both cupped and thinner at the end edges than in the midportion. The cupping is, naturally, greater for center wood than for surface wood. After drying of a 150 mm wide piece of lumber for example to shipping dryness (18–20% moisture ratio), the height of the cupping will be circa 2–3 mm. The cupping height then increases a few millimeters if drying is continued to room dryness (10–12% moisture ratio). Because of the cupping and shrinkage described here very large allowances must be made for subsequent splitting and/or planing of the wood. For example, a 50 mm thick piece of lumber must be planed down to about 45 mm in thickness. Thin pieces are often clamped flat during planing but recover, however, a cupped form after the planing operation, which is often unacceptable for the user. This has of course a negative effect on the volume yield of the log and thus the value yield of the same.

One method of reducing cupping is to hold the wood under pressure during drying, for example in a package. One such method is described in the publication by the Norsk Tretekniskt Institutt "Treteknisk Informasjon", No. 6, 1981. The effect on shrinkage, i.e. the reduction of the same, is rather good. One disadvantage, however, is that during pressing of the wood, stresses are created therein, which increase the risk of dry cracks. Furthermore, there is great risk that the residual stresses in the wood will cause cupping to occur at a later time, for example if the wood is rewetted and dried. This means that if a plane final product with a width about 150 mm for example is desired from the wood, an extra allowance of about 3–4 mm is required in a subsequent planing operation to compensate for the cupping.

One purpose of the present invention is to remove the disadvantages of the prior art and to suggest a new sawing method, by means of which the sawn out pieces of lumber, after drying to the desired moisture ratio, will have substantially plane parallel sides. For this purpose the method according to the invention in its broader sense is characterized in that the pieces of lumber are sawn out with longitudinal cut surfaces such that—when the log is viewed in cross section—the lateral surface facing the center of the log of the piece of lumber is substantially concave, while its lateral surface facing away from the center of the log is substantially convex, the concavity and convexity being adapted to the local tangential and radial shrinkage properties of the wood so that the sawn pieces, after drying to the desired moisture ratio, will have substantially plane-parallel sides. Such a method permits reduction of the working allowances for planing and splitting to less than half of what they are today. Furthermore, the pieces of lumber after drying are so plane that the need for after-calibrating the dimensions before use is reduced to a minimum for many uses, which reduces handling costs. A further advantage of the method according to the invention is that the sawn out pieces of lumber can lie more securely under tension in a package during the entire drying process than conventionally sawn lumber, which reduces for example superelevation and spring arising during drying and conditioning.

In a preferred embodiment of the method according to the invention, when the log is viewed in cross section, the pieces of lumber are sawn out with a plurality of longitudinal oppositely directed pairwise cuts, the entry points of which at the periphery of the log being symmetrically placed, with respect to a plane of symmetry passing through the center of the log, in two opposite adjacent quadrants of the log, said cuts running symmetrically with respect to said plane of symmetry and inclined to each other to a point of intersection in said plane of symmetry, the direction of each saw cut being such that the distance between the center of the log and the point of intersection is greater than the distance between the entry point and a plane perpendicular to the plane of symmetry and passing through the center of the log, measured along a line parallel to said plane of symmetry, the angle of inclination of the saw cuts being adapted to the tangential and radial shrinkage properties of the wood so that the sawn out pieces of lumber, after drying to the desired moisture ratio, will have substantially plane-parallel sides. The volume yield of the log can thereby be increased by about 2–4%, resulting in direct savings at today's prices of about $5.00 per cubic meter sawn.

Preferably, one of the substantially concave cut surfaces is made in the center portion of the log in such a way that the low quality pith and parts of the juvenile wood are sawn out. This step raises the quality of the center wood. In volume, this is compensated for by the rough measurements being made smaller in the center portion of the pieces of lumber than at the end edges and by a greater proportion of the high-quality outer portion being used for lumber. Depending on the expected tangential and radial shrinkage of the wood, as cuts are made in each quadrant successively farther from the plane which is perpendicular to the plane of symmetry, the angles of said cuts relative to said plane become successively smaller.

The invention will be described in more detail below with reference to the accompanying drawings, of which FIG. 1 shows schematically with dashed lines in the upper portion how pieces of lumber sawn with conventional straight cuts become cupped after drying.

Figure 1:
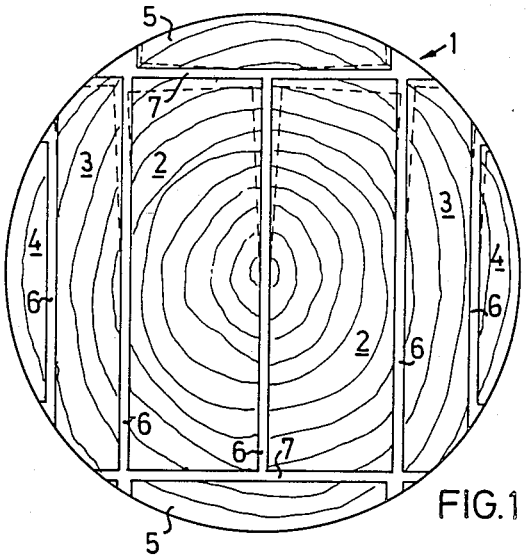
FIG.1 PRIOR ART

FIG. 1 shows schematically in cross section through a log 1 with solid lines how different pieces of lumber 2–5 are sawn out conventionally with parallel vertical and horizontal saw cuts 6 and 7. Due to the fact that the wood shrinks during drying substantially more tangentially than radially, the pieces of lumber 2–5 sawn out in this conventional manner will become cupped during drying and assume essentially the shape indicated by the dashed lines in the upper half of the log 1. A corresponding, reversed deformation will of course occur in the lower half of the log, although it is not shown in the figure. Due to the non-uniform shrinkage, the lateral surfaces of the log facing the center will assume an essentially convex shape while the lateral surface of the log facing away from the center will assume an essentially concave shape, with cupping decreasing as one moves away from the center of the log. As was mentioned in the introduction to the description, this cupping means that very large working allowances must be made in for example a planing operation after drying to obtain once again pieces of lumber with essentially plane parallel sides, and this of course results in poorer volume yield and increased costs for finishing.

According to the present invention there is suggested a sawing method, the basic idea of which is to divide the log into pieces of lumber with such cupped or angled saw cuts that the pieces after drying to the desired moisture ratio will have substantially plane-parallel sides. For this purpose the pieces of lumber 2, 3 and 4 are sawn out with a number of cut surfaces 8, 9, 10 and 11 running longitudinally to the log (FIGS. 2 and 4), which are oriented so that each piece's lateral surface facing the center of the log is substantially concave, while its lateral surface facing away from the log center is substantially convex, the concavity and convexity being adapted to the local tangential and radial shrinkage properties of the wood so that the sawn pieces 2, 3 and 4, after drying to the desired moisture ratio, will have substantially plane-parallel sides. Since the cupping on each side of the piece of lumber can be approximated with rather good accuracy to two plane surfaces 8*a*, 8*b*, 9*a*, 9*b*, 10*a*, 10*b*, 11*a*, 11*b*, the saw cuts can be made with opposing pairs of sawblades 12*a*, 12*b*, 13*a*, 13*b*, 14*a*, 14*b*, and 15*a*, 15*b* (see FIG. 4), which are angled so that the cuts are inclined as mirror images to each other to a point of intersection in a plane of symmetry A—A going through the center of the log, the direction of each saw cut being such that the distance $a_1$, $a_2$ . . . between the center of the log and the point of intersection is greater than the distance $b_1$, $b_2$ . . . between the entry points 16, 17 into the block and a plane B—B perpendicular to the plane of symmetry A—A and passing through the center of the log, measured along a line parallel to the plane of symmetry A—A. The angles of the saw cuts are adapted to the local tangential and radial shrinkage properties of the wood so that the pieces of lumber sawn out in this manner will have substantially plane-parallel sides after drying to the desired moisture content. In view of the fact that the shrinkage is less the farther away from the log center the sawn piece is, the cuts 8, 9, 10, 11 are made at successively smaller angles $\alpha$, $\beta$, $\delta$, and $\epsilon$ respectively to the plane B—B. In a more simple method, one can choose $\alpha=\beta=\delta=\epsilon$, but this will not produce full compensation for the cupping and no compensation for the difference in thickness after drying between the center and the edges of the pieces of lumber.

Figure 3:
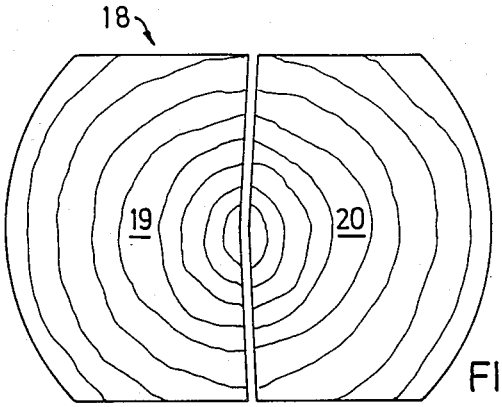
FIG. 3 shows an example of how a block of an edged log is first split in two halves with an angled, shrinkage-compensating cut prior to sawing the halves individually in a second step.
Figure 4:
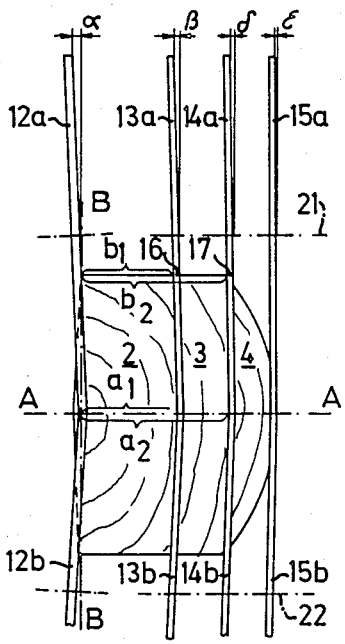
FIG. 4 shows how the righthand log half in FIG. 3 is sawn up according to the invention with the aid of opposing pairs of angled saw blades.

Sawing of a log 1 can be done for example by first edging the log in a conventional manner to a block 18, which is split into two substantially identical block halves 19 and 20 (FIG. 3) by means of an angled saw cut 8 (FIG. 2), and the block halves are then sawn up individually in the manner shown in FIG. 4. The block half 19 need not be sawn up with the pair of blades 12*a*, 12*b*. Alternatively, the block 18 can be split right in the center by means of a straight through-cut before being sawn according to FIG. 4.

The sawblades 12*a*, 13*a*, 14*a*, 15*a* and 12*b*, 13*b*, 14*b*, 15*b* on opposite sides of the log halves can be mounted on common shafts 21 and 22 respectively and be angled at different angles $\alpha$, $\beta$, $\delta$, and $\epsilon$ by means of adjustable blade guides (not shown). The opposing blades in each pair are staggered along the length of the log.

Figure 2:
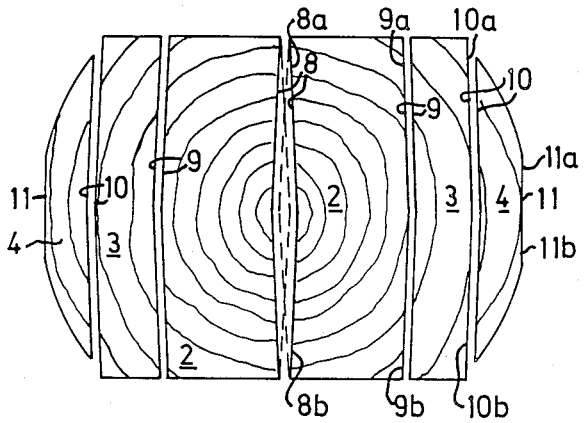
FIG. 2 shows an edged log which has been sawn up with shrinkage compensating cuts in accordance with the invention.

Another possible solution, although somewhat more complicated technically, is to saw the entire edged block 18 in one operation, as shown in FIG. 2, with the saw cuts in the two halves being oriented as mirror images of each other.

I claim:

1. Method for sawing a log into pieces of lumber, comprising sawing a log lengthwise to produce pieces of lumber having longitudinal cut surfaces, such that, in a cross section of the log, the lateral surface of each of said pieces of lumber facing the center of the log is substantially concave and the lateral surface of each of said pieces facing away from the center of the log is substantially convex, and adapting the degree of concavity and convexity to the local tangential and radial shrinkage properties of the wood so that, after drying said sawn out pieces of lumber to the desired moisture ratio, said cut surfaces of said pieces are substantially planar and parallel.

2. Method according the claim 1, and sawing out said pieces of lumber with a plurality of longitudinal angled pairs of cuts such that said pairs are inclined toward each other as mirror images of each other and intersect on a first plane of symmetry passing through the center of the log, directing the entry points of each of said pairs of cuts at the periphery of the log on opposite adjacent quadrants thereof so as to make said points symmetrical to each other with respect to said first plane of symmetry, directing each of said pairs of cuts so that the distance between the center of the log and the point of intersection between each of said pairs is greater than the distance between each of said entry points and a corresponding point lying on a second plane of symmetry transverse to said first plane of symmetry and passing through the center of the log, said smaller distance being measured on a line parallel to said first plane of symmetry, and adapting the angle of inclination of said pairs of cuts to the tangential and radial shrinkage properties of the wood, so that after drying said sawn out pieces of lumber to the desired moisture ratio, said cut surfaces of said pieces are substantially planar and parallel.

3. Method according to claim 1, and sawing one of said substantially concave cut surfaces such that the central longitudinal portion of the log is sawn out, said portion being low-quality pith.

4. Method according to claim 2, and directing said pairs of cuts so that in a cross-section of the log the angles of inclination of said saw cuts in each quadrant of the log with respect to said second plane of symmetry become successively smaller the farther away a saw cut is from said second plane of symmetry, and adapting said angles of inclination to the tangential and radial shrinkage properties of the wood.

5. Method according to claim 1, and sawing two opposite adjacent quadrants of the log at the same time as sawing the remaining two opposite adjacent quadrants to produce saw cuts in said two opposite adjacent quadrants which are symmetrical with respect to said second plane of symmetry to corresponding saw cuts in said remaining two opposite adjacent quadrants.

6. Method according to claim 1, and dividing the log lengthwise into two substantially identical halves and subsequently producing shrinkage-compensating saw cuts in each of said halves individually.

7. Method according to claim 1, and edging th log before sawing out said pieces of lumber.

8. Method according to claim 1, and sawing out the outer pieces of lumber obtained by edging the log with a concave surface on their board face facing the pith of the log, so as to obtain substantially flat pieces of lumber after drying said outer pieces.

* * * * *